United States Patent [19]

Hanson et al.

[11] 4,263,743

[45] Apr. 28, 1981

[54] NOVELTY TOY

[75] Inventors: Steven P. Hanson, Brea, Calif.; Burton C. Meyer, Downers Grove, Ill.

[73] Assignee: Marvin Glass & Associates, Chicago, Ill.

[21] Appl. No.: 106,284

[22] Filed: Dec. 21, 1979

[51] Int. Cl.[3] ..... A63H 33/26; G09F 19/08; A63J 23/00; F21L 9/00

[52] U.S. Cl. ..... 46/228; 46/165; 46/118; 46/120; 40/411; 362/806; 362/197; 272/27 R

[58] Field of Search ..... 46/228, 226, 170, 171, 46/97-99, 111, 112, 115-118, 162, 164; 40/416, 411, 421, 425, 444, 442, DIG. 902; 362/197, 250, 251, 252, 253, 806; 273/1 R, 161; 272/1 R, 8 R, 27 R, 8 D, 8 P, 8 M, 8 F; 35/17

[56] References Cited

U.S. PATENT DOCUMENTS

| | | | |
|---|---|---|---|
| 925,878 | 6/1909 | DeMoulin | 272/27 R |
| 1,877,940 | 9/1932 | Morgenstern et al. | 46/228 |
| 2,006,251 | 6/1935 | Rollins | 362/197 |
| 2,098,166 | 11/1937 | Rubenstein | 46/228 |
| 2,647,222 | 7/1953 | Nieset | 46/228 |
| 2,794,298 | 6/1957 | Mason | 46/228 |
| 2,880,408 | 3/1959 | Sewell | 46/226 |
| 3,009,265 | 11/1961 | Bezark | 35/17 |
| 3,179,791 | 4/1965 | Mole | 362/806 |
| 3,764,976 | 10/1973 | MacMahon | 362/201 |

*Primary Examiner*—Gene Mancene
*Assistant Examiner*—Michael J. Foycik
*Attorney, Agent, or Firm*—Mason, Kolehmainen, Rathburn & Wyss

[57] ABSTRACT

A novelty toy in the shape of a skull includes a cranial shaped housing and a pivotal jaw portion. The jaw is biased to a closed position by a biasing element and includes a grip portion to be gripped by the user of the device to move the jaw to an open position. A depending handle is also defined on the skull to allow the skull to be supported by the user. A pair of lights are mounted in the eye apertures and reflectors are rotatably mounted within the apertures surrounding the lightbulbs. A gear train connects the reflectors to a manually operated gear to allow rotation of the reflectors within the housing. Each reflector includes a colored lens that may be rotated in front of the light to provide a different appearance to the toy. The lights are connected through a switch mounted within the housing to a portable power source. The switch includes a plurality of positions for producing alternate lighting or flashing effects.

14 Claims, 5 Drawing Figures

NOVELTY TOY

BACKGROUND OF THE INVENTION

1. Field of the Invention

The present invention relates to novelty devices and in particular to a new and improved novelty toy in the shape of a skull.

2. Brief Description of the Prior Art

Older children in particular enjoy toys that involve sophisticated action as well as the use of lights. A favorite toy of this type is one that has an eery or frightening appearance such as a model of a human skull. Older children, however, quickly become bored or lose interest with these types of toys unless the variety of actions of the toys are sufficient to maintain the interest and prove challenging to the older child. Such toys are complex and expensive to manufacture, thus limiting their availability in the market place.

SUMMARY OF THE INVENTION

An object of the present invention is to provide a new and improved novelty device.

Another object of the present invention is to provide a new and improved novelty device that includes several actions and lights that can be operated in different modes.

A further object of the present invention is to provide a new and improved novelty toy that has an eery appearance that is simple and economical to manufacture.

The present invention is directed to a new and improved novelty toy fabricated in the configuration of a human skull that includes a handle to allow the user to hold and operate the skull with one hand. A jaw is pivotally mounted to the skull and biased to a closed position by a biasing member and includes a grip portion that may be gripped by a finger of the user to allow opening of the jaw. In addition, the skull includes a pair of apertures corresponding to eye sockets within which are positioned lights. Rotatably mounted within the skull and surrounding the lights are a pair of reflectors open at one side and including a red lens on the other side. The reflectors are rotatable within the skull by a gear train to a position to allow light to escape through the open part of the reflector or through the lens, depending on the desires of the user.

A portable source of energy, such as batteries, is mounted within the skull and connected through a switch to the lights. The switch may be actuated in three modes and includes a contact member rotatably mounted within the skull and movable to contact first and second terminals that are electrically connected to the first and second lights, respectively. In addition, a rigid contact connected to the source of energy is mounted within the skull in a position such that it may be vibrated between the terminals and the contact thus providing an alternate blinking or flashing effect to the lights.

BRIEF DESCRIPTION OF THE DRAWINGS

The above and other objects and advantages and novel features of the present invention will become apparent from the following detailed description of the preferred embodiment of the invention illustrated in the accompanying drawing wherein.

DESCRIPTION OF THE PREFERRED EMBODIMENT

Figure 1:
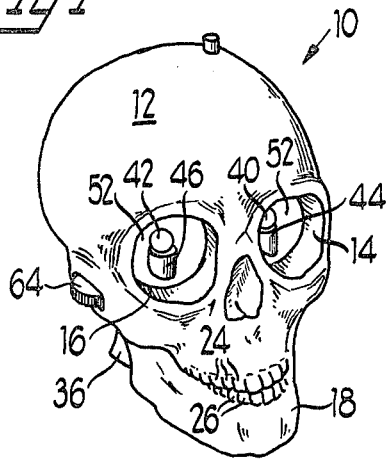
FIG. 1 is a perspective view of a toy constructed in accordance with the principles of the present invention.
Figure 3:
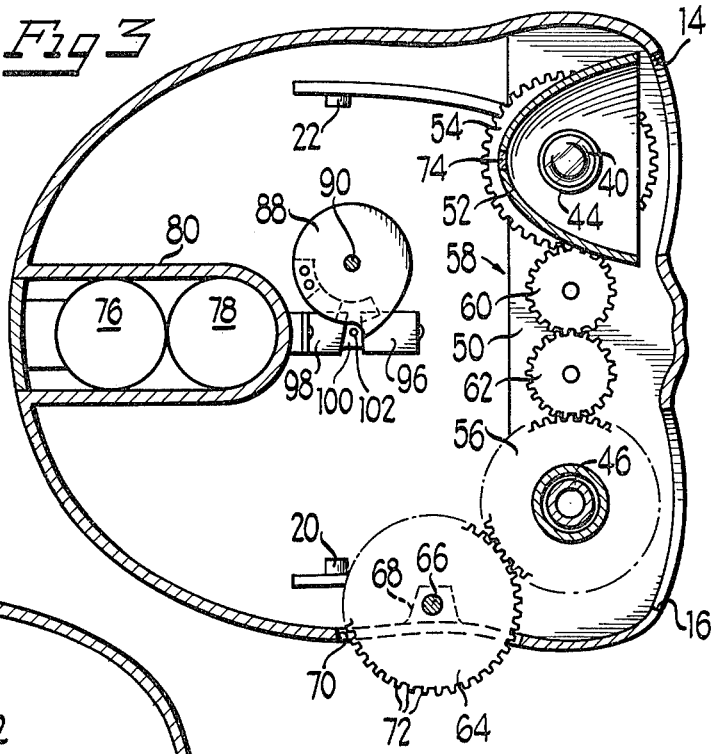
FIG. 3 is a view taken generally along line 3—3 of FIG. 2.

Turning now to the drawing and initially to FIG. 1, there is illustrated the novelty device or toy of the present invention generally designated by the reference numeral 10. The toy 10 in the preferred embodiment illustrated includes a cranial-shaped body 12 fabricated in the configuration of a human skull. The body includes a pair of apertures 14 and 16 that are fabricated to appear similar to eye sockets. The device 10 also includes a jaw portion 18 pivotally mounted to the skull body 12 by a pair of pins 20 and 22. The jaw portion 18 and the skull housing 12 include molded contoured surfaces 24 and 26, giving the appearance of teeth.

Figure 2:
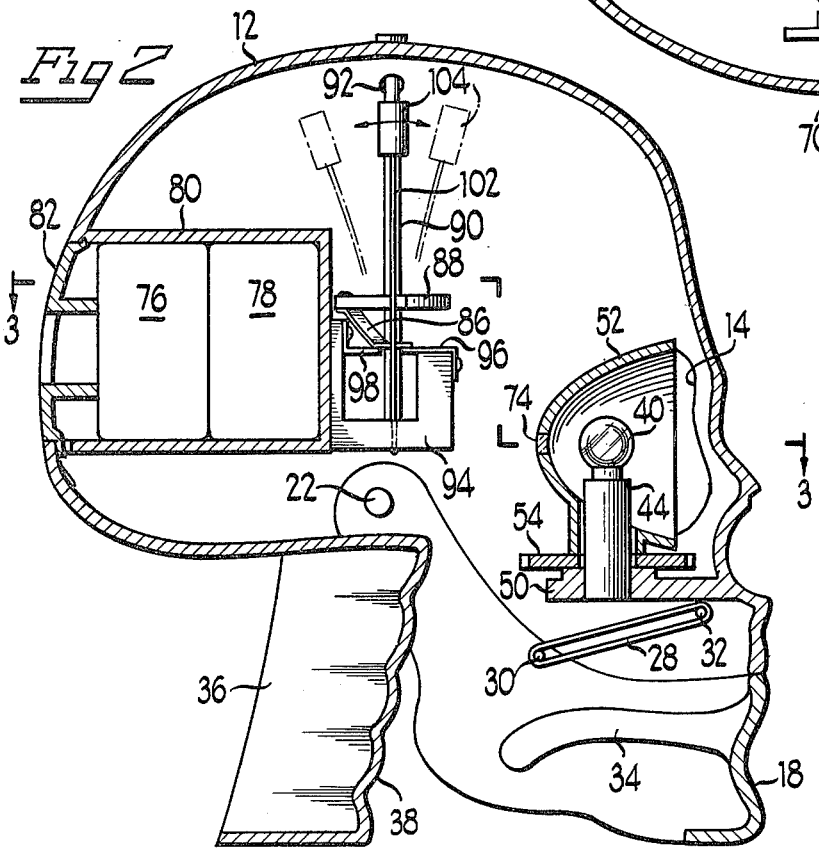
FIG. 2 is an enlarged vertical cross-sectional view of the toy illustrated in FIG. 1.
Figure 4:
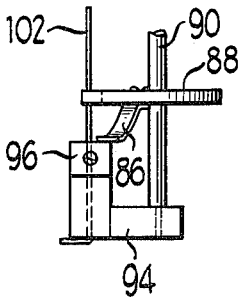
FIG. 4 is a partial vertical view of the switch of the present invention.

It is the purpose of the novelty toy 10 to be in the configuration of a small human skull and to include both action and an eery effect produced by lights. The action of the novelty toy 10 is provided by the jaw 18 opening and closing in a manner similar to the human mouth. Specifically, as illustrated in FIG. 2, the jaw is held in a closed position by a biasing element such as a rubberband 28 that is looped over a first pin 30 defined on the jaw 18 and a second pin 32 defined on the skull or body portion 12. In addition, the jaw includes a grip portion 34 that may be gripped by the finger of the child operating the novelty toy 10 to pivot the jaw 18 downwardly from the skull 12 in a manner corresponding to opening the mouth of the human. To allow ease of handling the novelty toy 10, a handle or hand grip 36 is molded on the skull 12 in the position of the neck and includes a gripping surface 38 to facilitate grasping by the user. Accordingly, a child may grip the handle 36 in one hand and extend a finger to engage the finger grip 34 thus permitting operation of the jaw 18 with one hand.

An eery lighting effect of the novelty toy 10 is provided by a pair of lightbulbs 40 and 42 mounted in the eye apertures 14 and 16. More particularly, the lightbulbs are mounted in sockets 44 and 46 secured to a mounting flange 50 integrally molded or secured to the interior of the housing 12. The lightbulbs 40 and 42 are each surrounded by rotatable parabolic reflectors 52 that are mounted by gears 54 and 56. The gears are rotatably mounted on the flange 50 to rotate about the sockets 44 and 46. The gears 54 and 56 are part of a gear train generally designated by the reference numeral 58 mounted on the flange 50. The gear train 58 includes a pair of idler gears 60 and 62 between the gears 54 and 56 and a manually rotatable gear 64 mounted within the skull 12 on a pin 66 secured to a flange 68. The gear 64 extends through a slot or aperture 70 on the side of the skull housing so that its teeth 72 may be manually engaged by the child operating the novelty toy 10 to rotate the gear 64. This rotation is transmitted to the gears 54 and 56 through the gear train 58 thus rotating the reflectors 52 about the lightbulbs 40 and 42.

The reflectors 52 each include at the back surface thereof a colored lens 74 that may be one of many colors such as red. Accordingly, upon rotation of the gears 64 the reflectors 52 are rotated to a position such that the light from the lightbulbs 40 and 42 will be cast through the reflectors 74 providing an eery appearance.

Figure 5:
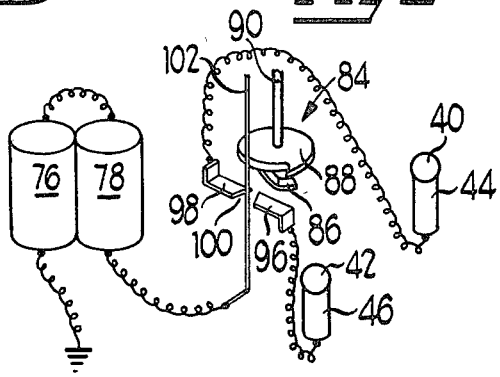
FIG. 5 is a perspective illustration of the electrical circuit elements of the toy of the present invention.

The lightbulbs 40 and 42 are energized by a pair of batteries 76 and 78 mounted within a housing 80 defined in the back of the skull 12 and covered by a removable cover 82. As best illustrated in FIG. 5, the lightbulbs 40 and 42 are electrically connected to the batteries 76 and 78 through a switch mechanism generally designated by the reference numeral 84. The switch mechanism 84 includes a metal contact 86 secured to a disc 88. The disc 88 is mounted on a shaft 90 that extends upwardly through an aperture 92 within the skull 12 and downwardly into a switch holding housing 94. By this mounting, the shaft 90 may be rotated within the skull 12 to rotate the disc 88 and the contact 86 between first and second terminals 96 and 98 that are connected to the lightbulbs 40 and 42, respectively. The contact 86 is of a sufficient dimension to bridge the gap 100 between the contacts 96 and 98 and contact the rod 102 to complete the circuit illustrated in FIG. 5 and constantly light the lightbulbs 40 and 42.

The toy 10 is intended to include two other light modes providing additional effects. More specifically, the switch 84 further includes the contact rod 102 that is sufficiently stiff and rigid to be mounted within the switch housing 94 at one end and to include a counterweight 104 at the other end so that by shaking the skull 12 the counterweight 104 will cause the switch rod 102 to vibrate within the housing or skull 12. By rotating the contact 86 away from the terminals 96 and 98 and then slightly rocking the toy 10, the switch rod 102 will vibrate between the terminals 96 and 98 alternately connecting these terminals to the batteries 76 and 78 and alternately blinking the lightbulbs 40 and 42 providing a second mode of lighting the toy 10. In the third mode of operation of the lightbulbs 40 and 42, the terminal 86 is positioned in the gap 100 to bridge the contacts 98 and 96. The novelty toy 10 may then be vibrated from side to side causing the switch wire 102 to vibrate against the contact 86 simultaneously connecting the lightbulbs 40 and 42 to the batteries 76 and 78 such that the lightbulbs 40 and 42 simultaneously flash.

Many modifications and variations of the present invention are possible in light of the above teachings. Thus, it is to be understood that, within the scope of the appended claims, the invention may be practiced other than as specifically described above.

What is claimed and desired to be secured by Letters Patent of the United States is:

1. A novelty toy, comprising:

a housing, generally in the configuration of a human skull;

a pair of apertures in said body;

a pair of lights mounted in said apertures;

switch means for energizing said lights, said switch means including first and second terminals electrically coupled to said first and second lights, respectively, and a vibratory contact means mounted in said body adjacent said first and second terminals for alternately energizing said lights and a pair of reflectors rotatably mounted in said housing and surrounding lights, respectively, each reflector including a colored lens in a portion thereof, and selectively operable manual drive means mounted in said body and connected to said reflectors for rotation thereof.

2. The novelty toy claimed in claim 1 further comprising a jaw pivotally mounted to said body and means for biasing said jaw to a closed position.

3. The novelty toy claimed in claim 1 further comprising a handle secured to said body.

4. A novelty toy, comprising:

a cranial housing in the configuration of a human skull;

first and second apertures corresponding to eye sockets defined in said body;

a jaw pivotally mounted on said skull;

means for biasing said jaw to a closed position;

first and second light sources positioned in said first and second apertures;

a source of energy for said light source;

switch means for alternately and constantly connecting said source of energy to said first and second light sources and first and second reflectors manually rotatably mounted in said first and second apertures generally about said light sources, said first and second reflectors further include a colored lens defined in a portion thereof.

5. The novelty toy claimed in claim 4 wherein said switch means includes first and second terminals electrically coupled to said first and second light sources, respectively, and a contact movably mounted in said body.

6. The novelty toy claimed in claim 5 wherein said switch means further includes a resilient contact mounted in said body adjacent said first and second terminals, said wire contact including a weight secured thereto to vibrate said wire upon vibration of said toy.

7. The novelty toy claimed in claim 5 further comprising a gear train mounted in said body and coupled to said first and second reflectors for rotation thereof upon actuation of said gear train.

8. The novelty toy claimed in claim 5 wherein said jaw further comprises a finger grip defined on said jaw.

9. A novelty device, comprising:

a body defining a cavity;

at least one aperture defined in said body;

means for producing light mounted in each aperture;

means for constantly and alternately energizing said light producing means, a large opening in said body and a cover for said opening pivotally mounted on said body and means for biasing said cover to a position covering said opening and a grip member on said cover to facilitate manual movement of said cover to a position uncovering said opening.

10. The novelty device set forth in claim 9 further comprising a handle secured to said body.

11. The novelty device set forth in claim 9 further comprising a reflector rotatably mounted in each aperture generally surrounding said light producing means.

12. The novelty device set forth in claim 11 wherein each reflector includes a colored lens.

13. The novelty device set forth in claim 9 further comprising a selectively operable drive means secured to said reflector for rotating the same.

14. The novelty device set forth in claim 9 wherein said energizing means for said light producing means includes a contact member mounted in said body and a weighted elongated contact mounted in said body so that vibration of the body alternately energizes the lights.

* * * * *